US008366518B2

(12) United States Patent
Bailey

(10) Patent No.: US 8,366,518 B2
(45) Date of Patent: Feb. 5, 2013

(54) ORBITAL SMOOTHING DEVICE

(75) Inventor: Wayne A. Bailey, Berlin, VT (US)

(73) Assignee: Miles Supply, Inc., Barre, VT (US)

( * ) Notice: Subject to any disclaimer, the term of this patent is extended or adjusted under 35 U.S.C. 154(b) by 428 days.

(21) Appl. No.: 12/703,966

(22) Filed: Feb. 11, 2010

(65) Prior Publication Data

US 2011/0195637 A1 Aug. 11, 2011

(51) Int. Cl.
*B24B 23/04* (2006.01)

(52) U.S. Cl. ..... 451/357; 451/359; 451/353; 451/28

(58) Field of Classification Search ..... 451/294, 451/366, 353, 360, 359, 354, 342, 347
See application file for complete search history.

(56) References Cited

U.S. PATENT DOCUMENTS

| | | | | |
|---|---|---|---|---|
| 1,928,390 | A | 9/1933 | Myers | |
| 3,110,988 | A | 11/1963 | Boettcher et al. | |
| 4,319,434 | A | 3/1982 | Brejcha | |
| 4,328,645 | A | 5/1982 | Sauer | |
| 4,939,872 | A | 7/1990 | Revelin et al. | |
| 6,244,943 | B1 * | 6/2001 | Bohler et al. | 451/294 |
| 6,811,475 | B2 * | 11/2004 | Riley | 451/359 |
| 6,848,984 | B2 * | 2/2005 | Bohler | 451/360 |
| 7,022,004 | B2 | 4/2006 | Bohler | |
| 7,048,620 | B1 | 5/2006 | Riley et al. | |
| 7,427,228 | B1 | 9/2008 | Kirsch | |
| 8,251,780 | B2 | 8/2012 | Ward et al. | |
| 2007/0232206 | A1 * | 10/2007 | Shorrock et al. | 451/350 |

FOREIGN PATENT DOCUMENTS

| | | |
|---|---|---|
| EP | 1 477 276 A1 | 11/2004 |

* cited by examiner

*Primary Examiner* — Dung Van Nguyen
(74) *Attorney, Agent, or Firm* — Carmody & Torrance LLP

(57) ABSTRACT

Disclosed are an orbital smoothing device for smoothing a surface of a substrate and a method of smoothing a surface of a substrate using the orbital smoothing device. The orbital smoothing device includes a rotatable plate that is drivable by a motor in at least one of a clockwise or a counterclockwise direction and a plurality of smoothing pad assemblies coupled to said plate. Each of the plurality of smoothing pad assemblies is capable of independent rotation in both clockwise and counterclockwise directions and includes a shaft for coupling each of said smoothing pad assemblies to the rotatable plate, means for providing independent rotation in both clockwise and counterclockwise directions mounted on the shaft and securable in a pad holder and a pad holder for receiving and securing the means for independent rotation. The pad holder has removably mounted thereon a smoothing pad capable of smoothing the surface of the substrate when the rotatable plate is driven by the motor.

19 Claims, 5 Drawing Sheets

ORBITAL SMOOTHING DEVICE

FIELD OF THE INVENTION

The present invention relates generally to a device for smoothing and/or polishing various materials.

BACKGROUND OF THE INVENTION

The present invention relates generally to a device capable of smoothing and/or polishing various materials. Smoothing includes grinding, stock removal, honing, polishing, sanding and similar actions of flat and curved surfaces to polish and/or smooth such surfaces. Abrasives are used to cut and polish surface areas of materials, including stone, ceramic, engineered stone, concrete, metal, glass, wood, composite materials and combinations of one or more of the foregoing, by way of example and not limitation.

Polishing and smoothing devices are well known in the art. Various devices have been suggested that include a main body and a head or plurality of heads rotating in the direction of the contact surface and that utilize an abrasive surface. For example, U.S. Pat. No. 7,022,004 to Böhler, the subject matter of which is herein incorporated by reference in its entirety, describes a device utilizing three tool holding fixtures driven by a central motor and a set of gears in a triangular system for rotation around their own rotational access such that the tool holding fixtures are rotatably mounted at least around a rotating axis serving as a work axis and each of the tool holding fixtures requires a driving means for rotating each of the tool holding fixtures. Another polishing device is described in U.S. Pat. No. 7,427,228 to Kirsch, the subject matter of which is herein incorporated by reference in its entirety, which is a handheld material conditioner including at least three orbital head assemblies.

However, all of these orbital polishing devices use rotating polishing heads that are mounted to a plate and the plurality of polishing heads are simultaneously driven by an attached or external motor which powers a spindle or shaft in combination with a series of gears and/or belts to rotate the plurality of orbital polishing heads at the same speed in the same direction. These polishing heads force the rotational direction of the abrasive pad to any contact area and all of the polishing heads are driven by the mechanical means to simultaneously rotate the polishing heads without any independent motion.

One of the problems associated with these orbital polishing devices is that when substrates to be smoothed or polished have surfaces that are curved or uneven, the simultaneous motion of all the orbital polishing heads can cause these uneven and curved portions to be flattened and/or rounded over. In addition, by using mechanical force such as gears and/or belts, the abrasive polishing pad can produce an uneven surface on the material to be polished, resulting in imperfections.

It would be desirable to provide an orbital smoothing and/or polishing device in which each of the plurality of polishing heads is capable of independent rotation. It would also be desirable to provide a device that is capable of self-leveling on uneven surfaces so that such surfaces can be more evenly polished.

In addition, these orbital polishing devices can be used as a single device hooked up to a motor (i.e., a "handheld" device) or alternatively, can be used in slab polishing machine. Slab polishing machines are used for polishing materials such as stone slabs and other like materials and multiple orbital polishing devices are mounted to smooth or polish the entire width of the slab simultaneously.

One of the problems with using these orbital polishing devices in a slab polishing machine is that the polishing assemblies can become worn out and the gears and belts can break. If this happens, the slab polishing machine must be taken off line so that the orbital polishing device can be taken apart and rebuilt. Thus, it would be desirable to provide an orbital polishing device for use in a slab polishing machine that can be more easily repaired and replaced.

SUMMARY OF THE INVENTION

It is an object of the present invention to provide an orbital smoothing device that allows for each of a plurality of orbital polishing heads to rotate independently of each other.

It is another object of the present invention to provide an orbital smoothing device in which the plurality of orbital polishing heads are not driven by an external mechanical force.

It is still another object of the present invention to provide an orbital smoothing device in which the plurality of orbital polishing heads do not require gears or pulleys to rotate.

It is still another object of the present invention to provide an orbital smoothing device that is capable of polishing curved and uneven surfaces.

It is another object of the present invention to provide an orbital smoothing device that is capable of self-leveling against such curved and uneven surfaces.

To that end, in a preferred embodiment, the present invention relates generally to an orbital smoothing device for smoothing a surface of a substrate, said orbital smoothing device comprising:

a) a rotatable plate, wherein said plate is drivable by a motor in at least one of a clockwise or a counterclockwise direction; and b) a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises:

i) a shaft for coupling each of said smoothing pad assemblies to the rotatable plate;

ii) means for providing independent rotation in both clockwise and counterclockwise directions mounted on the shaft and securable in a pad holder; and iii) a pad holder for receiving and securing the means for independent rotation, said pad holder having removably mounted thereon a smoothing pad capable of smoothing the surface of the substrate when the rotatable plate is driven by the motor, wherein each of the plurality of smoothing pad assemblies independently rotates in the clockwise and/or the counterclockwise direction.

In another preferred embodiment, the present invention relates generally to a method of smoothing a surface of substrate using an orbital smoothing device, said orbital smoothing device comprising a rotatable plate drivable by a motor in at least one of a clockwise or a counterclockwise direction and a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises a shaft for coupling each of said smoothing pad assemblies to the rotatable plate, means for providing independent rotation in both clockwise and counterclockwise directions mounted on the shaft and securable in a pad holder and a pad holder for receiving and securing the means for independent rotation, said pad holder having removably mounted thereon a smoothing pad capable of smoothing the surface of the substrate when the rotatable plate is driven by the motor, wherein each of the plurality of smoothing pad assemblies independently rotates in the clockwise and/or the counterclockwise direction;

said method comprising the steps of:

a) contacting the surface of the substrate to be smoothed with the plurality of smoothing pad assemblies; and b) driving the rotatable plate by the motor in at least the clockwise or counterclockwise direction, wherein each of the plurality of smoothing pad assemblies independently rotates in the clockwise and/or the counterclockwise direction due to friction between the smoothing pad of each of the plurality of smoothing pad assemblies and the surface to be smoothed.

BRIEF DESCRIPTION OF THE DRAWINGS

For a fuller understanding of the invention, reference is had to the following description taken in connection with the accompanying figures, in which.

Also, while not all elements may be labeled in each figure, all elements with the same reference number indicate similar or identical parts.

DETAILED DESCRIPTION OF THE PREFERRED EMBODIMENTS

The present invention relates generally to a surface smoothing device which can be used as either a handheld device or, in the alternative, as one of a plurality of smoothing/polishing devices in a slab machine for smoothing or conditioning slabs of substrate material. In addition, in one aspect of the invention, the device is capable of smoothing curved surfaces of a substrate, without flattening out or rounding over such surfaces.

To that end, in one preferred embodiment the present invention relates generally to an orbital smoothing device for smoothing a surface of a substrate, the orbital smoothing device comprising:

a) a rotatable plate, wherein said plate is drivable by a motor in at least one of a clockwise or a counterclockwise direction; and b) a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises:

i) a shaft for coupling each of said smoothing pad assemblies to the rotatable plate;

ii) means for providing independent rotation in both clockwise and counterclockwise directions mounted on the shaft and securable in a pad holder; and iii) a pad holder for receiving and securing the means for independent rotation, said pad holder having removably mounted thereon a smoothing pad capable of smoothing the surface of the substrate when the rotatable plate is driven by the motor, wherein each of the plurality of smoothing pad assemblies independently rotates in the clockwise and/or the counterclockwise direction.

Figure 1:
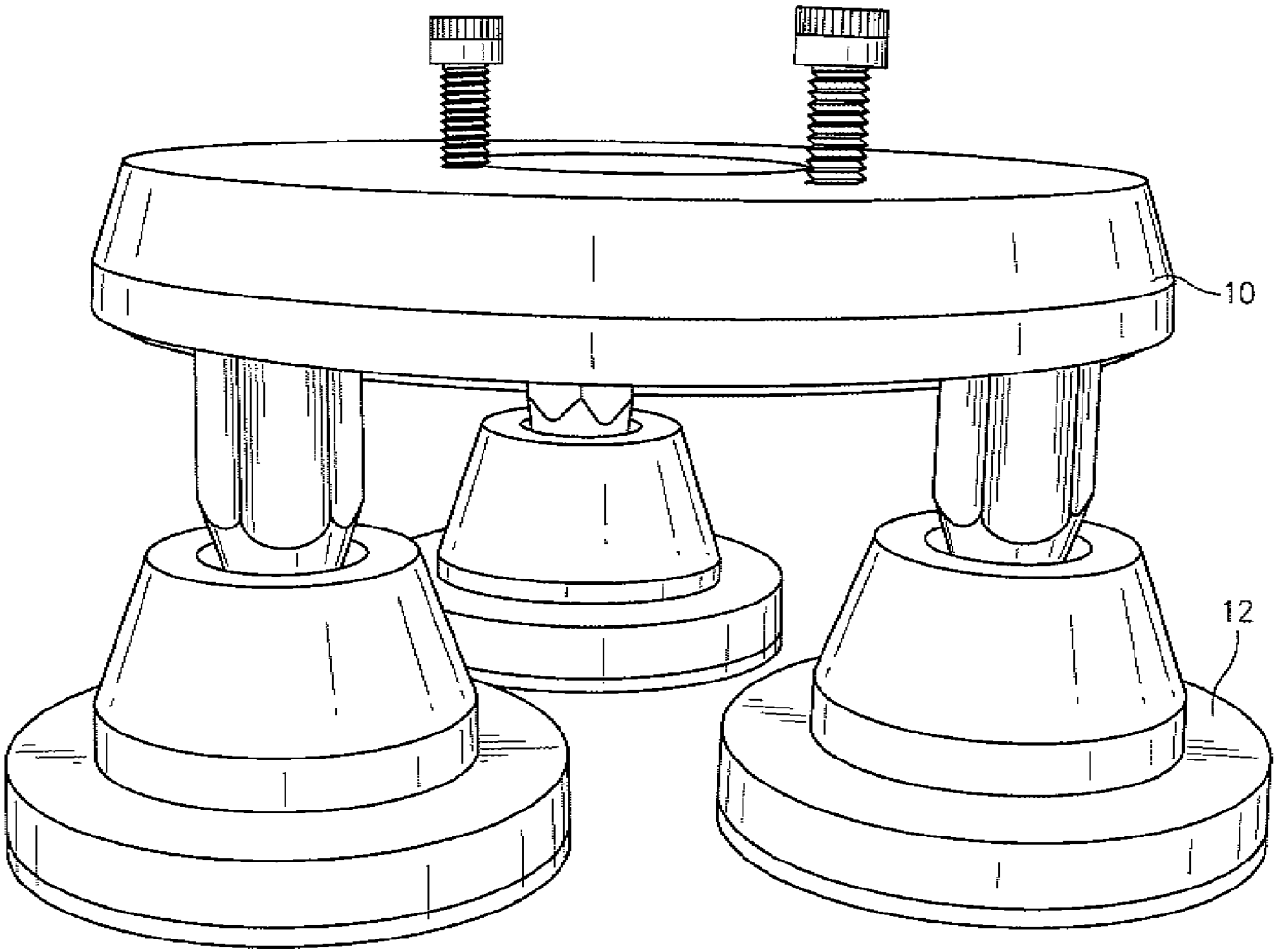
FIG. 1 depicts an orbital smoothing device in accordance with one aspect of the invention.

As best seen in FIG. 1, in a preferred embodiment the orbital smoothing device of the invention generally comprises a rotatable plate 10, wherein said rotatable plate 10 is drivable by a electrical/mechanical motor 60 (shown in FIG. 7) in at least one of a clockwise or a counterclockwise direction; and a plurality of smoothing pad assemblies 12 coupled to said plate 10, wherein each of said plurality of smoothing pad assemblies 12 is capable of independent rotation in both clockwise and counterclockwise directions. In addition, while the rotatable plate 10 is depicted in the figures as being round, other shapes could also be used in the practice of the present invention. For example, it is contemplated that a star-shaped plate can be used in which portions of the plate material have been removed in order to reduce the weight of the rotatable plate 10.

Figure 2:
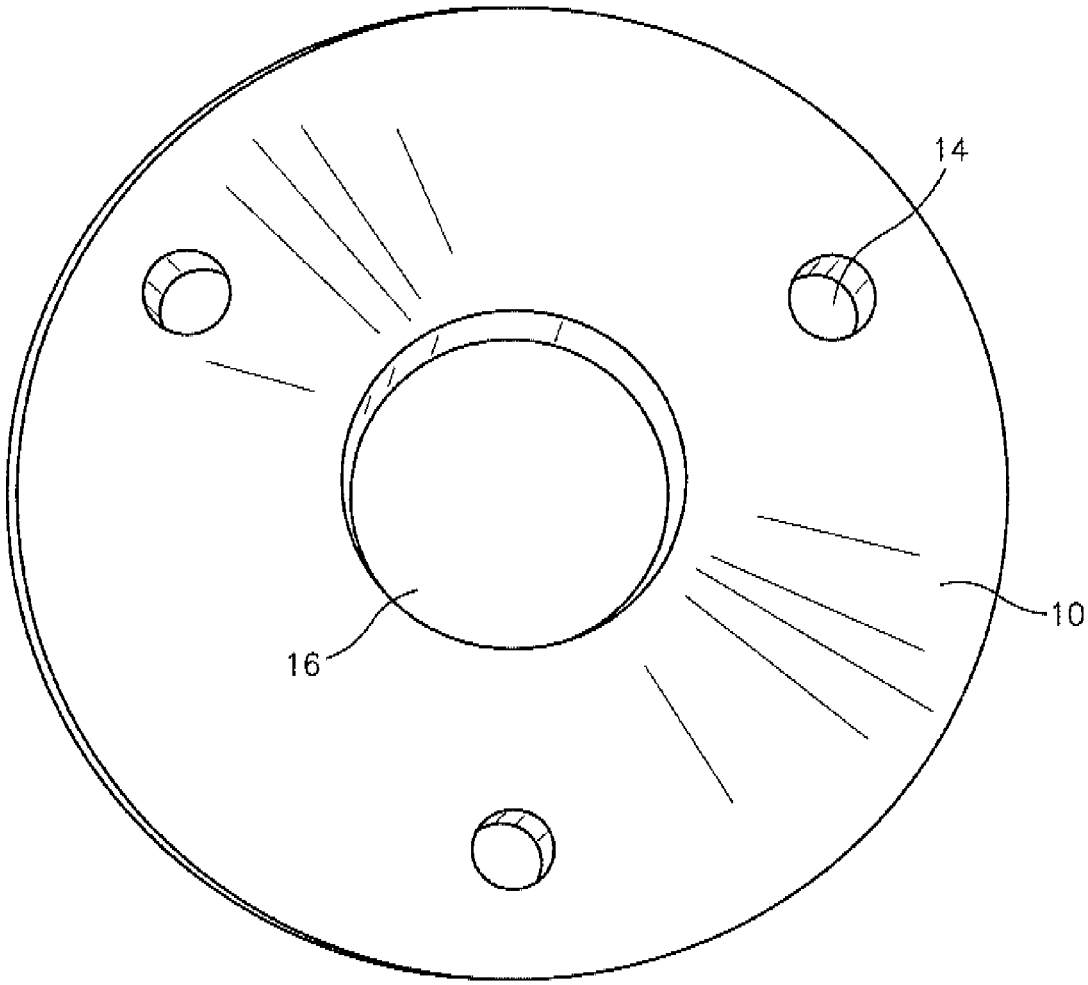
FIG. 2 depicts a plate of the orbital smoothing device in accordance with one aspect of the invention.

As seen in FIG. 2, in one preferred embodiment the rotatable plate 10 includes a plurality of openings 14 through which each of the plurality of smoothing pad assemblies 12 may be coupled to the rotatable plated 10. The rotatable plate 10 also optionally, but preferably, includes an opening 16 therein through which water may be fed to aid in the polishing/smoothing action. In a preferred embodiment, the orbital smoothing device of the invention may be water fed, in which water is provided as a lubricant and cleaning solution for the substrate to be treated and also to reduce friction. In the alternative, the water feed can be omitted in certain application where it is not needed and/or not desired.

The rotatable plate 10 is typically constructed of a material such as steel, aluminum, hard plastic or resin, and other similar materials, by way of example and not limitation and accepts the mounting of and host for the pads themselves. In one preferred embodiment, the rotatable plate is constructed of aluminum. In another preferred embodiment, the rotatable plate is constructed of a hard plastic resin.

Figure 3:
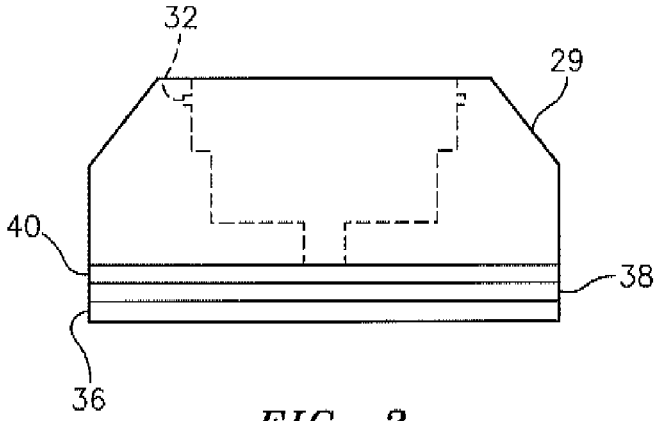
FIG. 3 depicts an exploded view of polishing pad assembly in accordance with one aspect of the present invention.

In a preferred embodiment, as depicted in FIG. 3, each of the plurality of smoothing pad assemblies 12 comprises a shaft 18 for coupling each of said smoothing pad assemblies 12 to the rotatable plate 10 through opening 14. The shaft 18 may be coupled to the rotatable plate by 10 bolting the shaft 18 thereto. However other means of coupling the shaft 18 to the rotatable plate 10 may also be used in the practice of the invention.

The shaft 18 has mounted thereon a washer 20, a rubber spacer 22 and a hexagonal spacer 24. Also mounted on the shaft 18 is a ball bearing 28, which provides independent rotation in both clockwise and counterclockwise directions. Various ball bearings may be used in the practice of the invention, however one suitable bearing is a single row deep groove ball bearing such as available from Nachi-Fujikoshi Corp., Japan. Other means for providing independent rotation in both clockwise and counterclockwise directions would also be usable in the practice of the present invention. In addition, the placement of the rubber spacer 22 is not critical and the rubber space 22 may be positioned above or below the rotatable plate to produce the desired result.

The ball bearing 28 is securable in pad holder 29 that receives and secures the ball bearing 28 therein. In a preferred embodiment, the ball bearing 28 is securable in the pad holder 29 by means of a snap ring 26 that fits into a circular groove 32 in the pad holder 29. Other means of securing the ball bearing 28 as well as other means for providing independent rotation are also usable in the practice of the invention and would be generally known to those skilled in the art. The pad holder 29 has removably mounted thereon a smoothing pad 36 capable of smoothing the surface of the substrate when the rotatable plate 10 is driven by the motor, and each of the plurality of smoothing pad assemblies 12 independently rotates in the clockwise and/or the counterclockwise direction. A second washer 30 may also be mounted on the shaft 18 below the ball bearing 28. The pad holder 29 is typically constructed of aluminum or aluminum alloy, stainless steel, hard plastic or resin, and combinations thereof. In a preferred embodiment, the pad holder 29 is constructed of aluminum.

Figure 6:
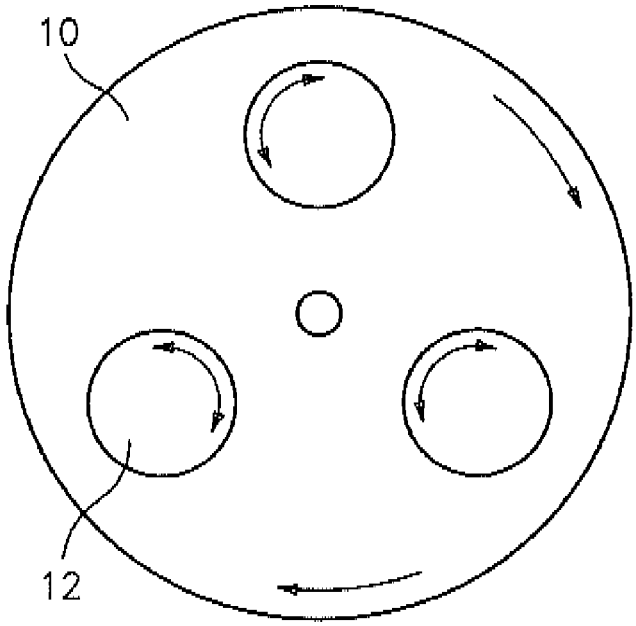
FIG. 6 depicts the backside of the rotatable plate having a plurality of polishing pad assemblies mounted thereon.

As discussed above, one of the advantages of the present invention is that each of the plurality of smoothing pad assemblies 12 independently rotate in the clockwise and/or the counterclockwise direction due solely to friction between the smoothing pad 36 and the surface to be smoothed, which is further shown in FIG. 6, which depicts the back side of the rotatable plate 10 with the plurality of polishing pad assemblies 12 mounted thereon and demonstrate the rotational movement of the rotatable plate relative to the plurality of polishing pad assemblies 12. When used herein, the term "independently rotates" is intended to mean that each of the smoothing pad assemblies 12 can rotate independently of the other in a clockwise or a counterclockwise direction. In other words, the plurality of smoothing pad assemblies 12 are not driven by an outside mechanical force, such as a belt or pulley and in fact belts and pulleys are not required nor preferred for use in the device of the present invention to cause movement of each of the plurality of smoothing pad assemblies 12.

Thus, in a preferred embodiment, no outside mechanical force is used to drive the rotation of each of the plurality of smoothing assemblies 12 and the plurality of smoothing pad assemblies 12 are each separately rotatable in a clockwise and a counterclockwise direction and are not mechanically engaged. The rotation of the smoothing pad assemblies is driven only by the friction of the smoothing pad 36 against the surface to be smoothed or polished and the friction of the smoothing pad 36 against the surface to be smoothed or polished drives the rotation of the rotatable plate, which allows each of the plurality of smoothing pad assemblies 12 to rotate independently of each other in a clockwise and counterclockwise direction.

Figure 4:
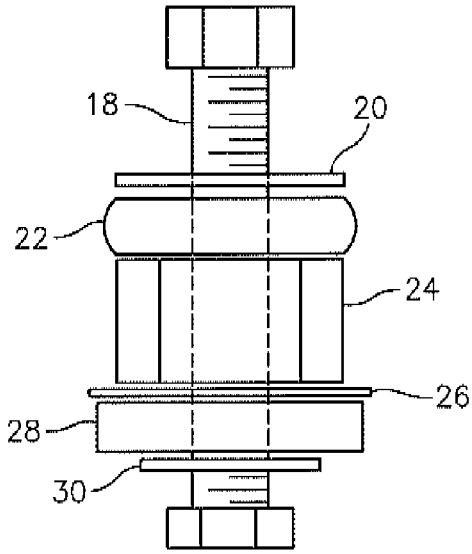
FIG. 4 depicts an exploded view of a smoothing pad assembly in accordance with another aspect of the present invention.
Figure 4:
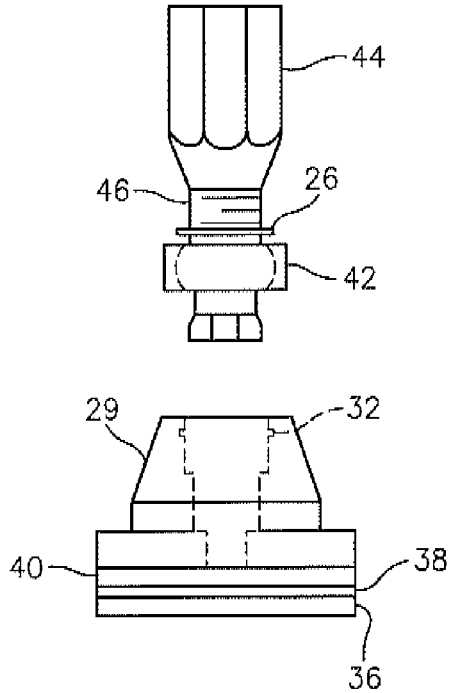
Figure 5:
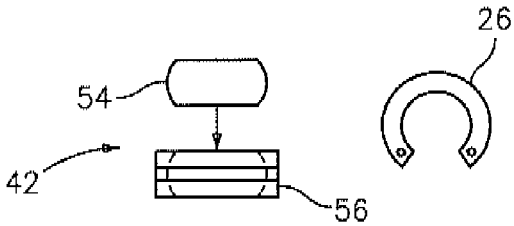
FIG. 5 depicts a spherical bushing in accordance with one aspect of the present invention.
Figure 7:
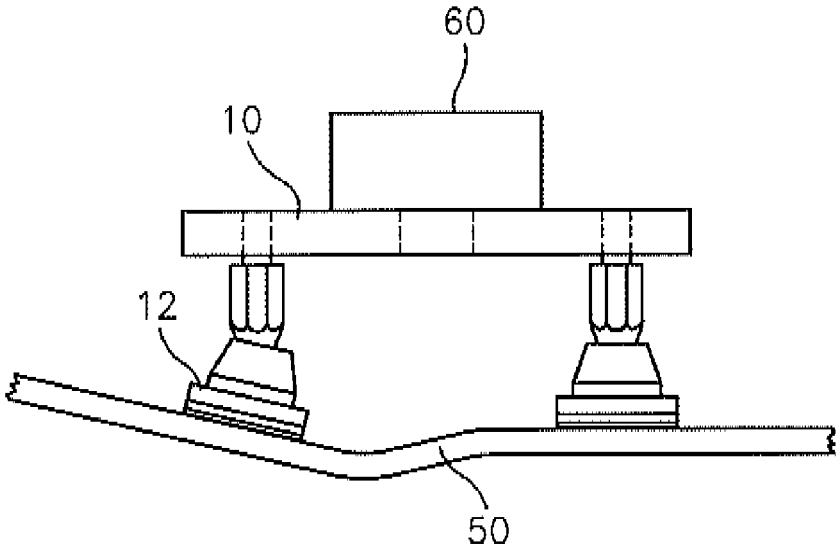
FIG. 7 depicts the smoothing pad assembly depicted in FIG. 8 as it used for smoothing an uneven surface.
Figure 8:
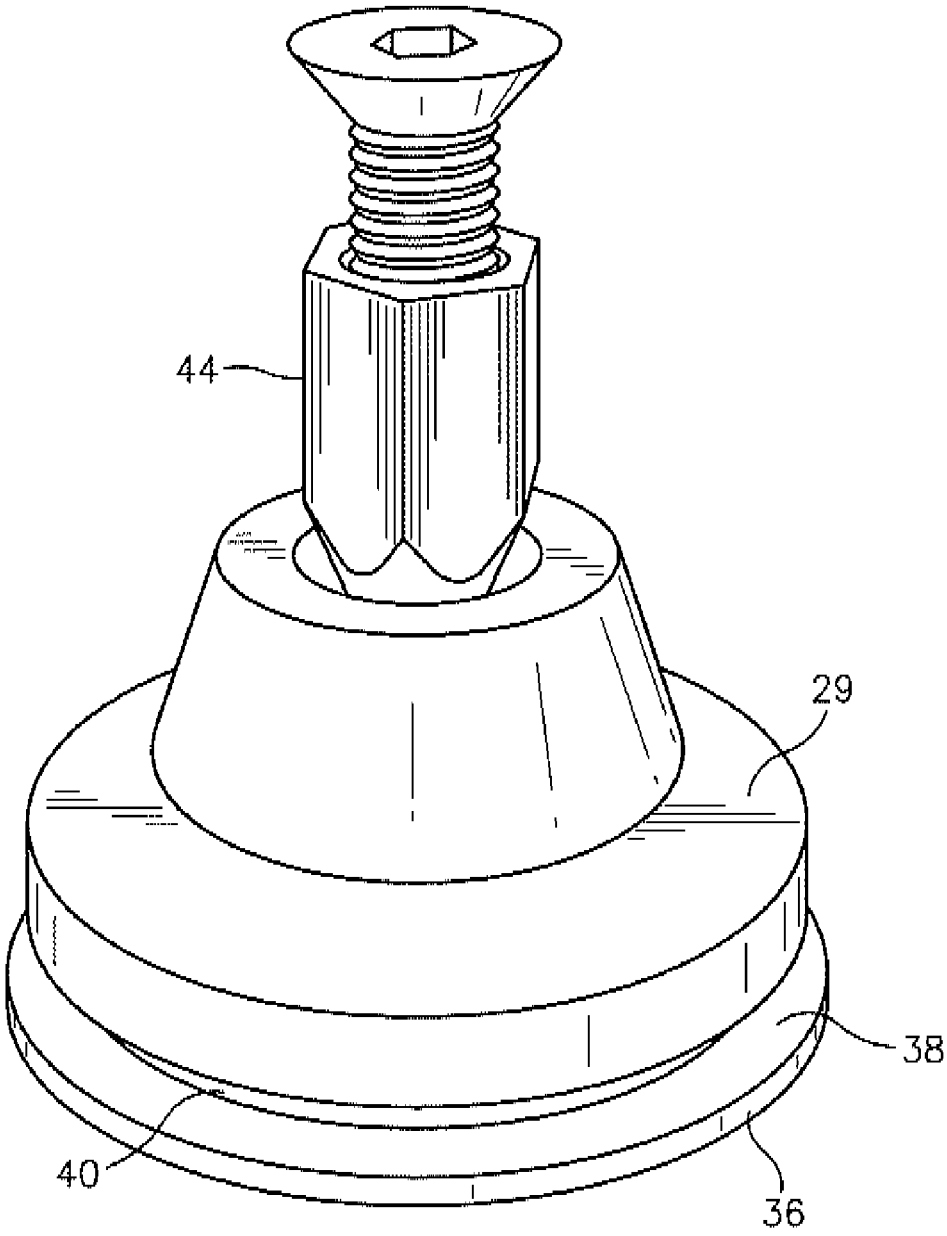
FIG. 8 depicts an assembled smoothing pad assembly in accordance with one aspect of the invention.

In another preferred embodiment and as depicted in FIG. 4, the shaft 44 encompasses both a spacer portion 44 and a threaded portion 46 and the spacer portion is secured to the rotatable plate 10. Mounted on the threaded portion 46 is a spherical bushing 42 which provides the means for providing independent rotation in both clockwise and counterclockwise directions which is securable in the pad holder 29 with a securing means such as snap ring 26 that fits into a circular groove 32 in the pad holder 29. The spherical bushing 42 is also depicted in FIG. 5 which shows the spherical inner bearing 54 arranged inside the spherical outer bearing 56 which allows the spherical bushing not only rotational movement but also movement in a vertical (i.e., up and down) direction, as shown in FIG. 8. FIG. 7 depicts the movement of a plurality of polishing pad assemblies 12 against an uneven surface 50 when using spherical bushing 42.

The use of spherical bushing 42 is desirable in a smoothing device that is to be used on both flat and curved portions of a substrate because the spherical bushing 42 allows each of the plurality of smoothing pad assemblies to self-level against uneven and curved surfaces. However, while the use of the spherical bushing 42 is desirable in this application (i.e., for curved and uneven surfaces), it may not be desirable in applications such as a slab polishing machine, where the surfaces to be polished or smoothed are relatively flat, because the additional movement allowed by the spherical bushing 42 (i.e., up and down movement) can cause one or more of the plurality of polishing pad assemblies 12 to slide off the edge of the surface to be polished and to tilt and possibly even jam against the edge of the surface.

The smoothing pad 36 is removably mounted to the pad holder 29 by securing means 38. The securing means typically include hook and loop fasteners, adhesives, magnets and clamps by way of example and not limitation. The securing means 38 is in turn mounted on a rubber pad 40 which is secured to the holder 29. Typically, the securing means 38 is mounted on the rubber pad 40 and the rubber pad is mounted to the pad holder 29 using a suitable adhesive. In one embodiment, the adhesive comprises a thermosetting adhesive such as a contact cement or an epoxy adhesive.

The device described herein can be used in slab polishing machines that utilize multiple polishing heads. As discussed above, these slab polishing machines are designed, for example for polishing granite and marble slabs, engineered materials and countertop slabs and perform pre-polishing, rough-polishing, finish-polishing and burnishing continuously.

Typically smoothing pad 36 comprises an abrasive surface that is suitable for polishing or microfinishing a selected surface. The smoothing pad 36 may utilize various abrasives depending on the surface being polished, including, but not limited to felt, cocoa mats, sandpaper, and resins impregnated with various abrasives including diamond, boron carbide aluminum oxide, silicon carbide, tin oxide, cerium oxide, and sinter powder and include both loose and bonded abrasives. Particle sizes of the abrasive may range from submicron up to about 15 microns depending on the application.

The smoothing pads 36 usable with the smoothing head assembly 12 are typically round so as to coincide with the shape of the smoothing pad assembly 12. However, both the smoothing pads 36 and the surface of the smoothing pad assembly that receives the smoothing pad 36 can have a different shape as well, such as diamond shape or an oval shape, depending on the surface being treated and the availability of the smoothing pads 36.

Furthermore, in a preferred embodiment, each of the plurality of smoothing pad assemblies 12 is capable of rotating at speeds as low as 50 rpm, for example when using a felt buffer, up to about 10,000 rpm depending in part on the abrasive being used in the polishing pad 36, the tools and the surface being smoothed and/or polished. In one preferred embodiment, each of the plurality of smoothing pad assembles 12 independently rotates at a speed between about 200 and 500 rpm.

As disclosed herein, the resistance of each of the individual smoothing pad assemblies 12 against the surface of the material to be smoothed or polished is preferably the only force used to cause the rotational movement of the each of the individual smoothing pad assemblies and each individual smoothing pad assembly is capable of independent rotation in both a clockwise and a counterclockwise direction. There is no driving force for the individual smoothing pad assemblies 12 and no belts or gears are required to provide movement.

The plurality of smoothing pad assemblies are mounted on the rotatable plate 10 at least approximately equidistant from each other. In a preferred embodiment, a minimum of three individual smoothing pad assemblies 12 are mounted on the rotatable plate 10. However, in some applications at least four or more individual smoothing pad assemblies 12 may be used, depending in part on the size of each individual smoothing pad 12 and the size of the rotatable plate 10 to which the plurality of smoothing pad assemblies 12 are attached. Again, each of the individual smoothing pad assemblies 12 is capable of independent rotation and independently rotates while the rotatable plate 10 is rotatably driven by the mechanical/electrical motor 60.

Materials that can be treated with the orbital smoothing device described herein include, but are not limited to stone, ceramic, engineered stone, concrete, metal, glass, wood, composite materials, laminates and combinations of one or more of the foregoing.

In another preferred embodiment, the present invention also relates generally to a method of smoothing a surface of a substrate using the orbital smoothing device described herein, the method comprising the steps of:

a) contacting the surface of the substrate to be smoothed with the plurality of smoothing pad assemblies; and b) driving the rotatable plate by the motor in at least the clockwise or counterclockwise direction, wherein each of the plurality of smoothing pad assemblies independently rotates in the clockwise and/or the counterclockwise direction due to friction between the smoothing pad of each of the plurality of smoothing pad assemblies and the surface to be smoothed.

As described in detail above, the plurality of smoothing pad assemblies are not driven by an outside mechanical force. All that is necessary to independently drive the rotation of each of the plurality of smoothing pad assemblies is friction between the smoothing pad of each of the plurality of smoothing pad assemblies and the surface to be smoothed.

It should also be understood that the following claims are intended to cover all of the generic and specific features of the invention described herein and all statements of the scope of the invention that as a matter of language might fall there between.

What is claimed is:

1. An orbital smoothing device for smoothing a surface of a substrate, said orbital smoothing device comprising:

a) a rotatable plate, wherein said plate is driveable by a motor in at least one of a clockwise or a counterclockwise direction; and b) a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises:

i) a shaft for coupling the respective smoothing pad assembly to the rotatable plate;

ii) means for providing independent rotation in both clockwise and counterclockwise directions mounted on the shaft and securable in a pad holder; and iii) a pad holder for receiving and securing the means for independent rotation, said pad holder having removably mounted thereon a smoothing pad capable of smoothing the surface of the substrate when the rotatable plate is driven by the motor, wherein each of the plurality of smoothing pad assemblies rotates independent of the other of the plurality of smoothing pad assemblies in the clockwise and/or the counterclockwise direction and the resistance of each of the plurality of smoothing pad assemblies against the surface of the substrate is substantially the only force that causes rotational movement of each of the plurality of smoothing pad assemblies.

2. The orbital smoothing device according to claim 1, wherein the plurality of smoothing pad assemblies are not driven by an outside mechanical force.

3. The orbital smoothing device according to claim 1, wherein the means for providing independent rotation is secured in the pad holder with a snap ring.

4. The orbital smoothing device according to claim 1, wherein the means for providing independent rotation comprises a spherical bushing.

5. The orbital smoothing device according to claim 4, wherein the spherical bushing allows each of the plurality of smoothing pad assemblies to self level against the surface of the substrate being smoothed.

6. The orbital smoothing device according to claim 1, wherein the smoothing pad mounted on the pad holder is removably mounted to the pad holder by securing means selected from the group consisting of hook and loop fasteners, adhesives, magnets, clamps and combinations of one or more of the foregoing.

7. The orbital smoothing device according to claim 6, wherein the smoothing pad is secured to a rubber pad and said rubber pad is secured to the pad holder.

8. The orbital smoothing device according to claim 1, wherein the means for providing independent rotation comprises a ball bearing.

9. The orbital smoothing device according to claim 8, wherein the ball bearing is mounted on the shaft and one or more spacers are mounted on the shaft between the ball bearing and the rotatable plate.

10. The orbital smoothing device according to claim 9, wherein the one or more spacers comprise a metal spacer and a rubber spacer.

11. The orbital smoothing device according to claim 1, wherein the rotatable plate comprises a material selected from the group consisting of plastic resin, aluminum and aluminum alloys, stainless steel and combinations of one or more of the foregoing.

12. The orbital smoothing device according to claim 1, wherein each of the plurality of pad holders comprises a material selected from the group consisting of plastic resins, aluminum and aluminum alloys, stainless steel and combinations of one or more of the foregoing.

13. The orbital smoothing device according to claim 1, wherein each of said plurality of smoothing pad assemblies is independently rotatable at a speed of between about 200 and about 500 rpm.

14. The orbital smoothing device according to claim 1, wherein the plurality of smoothing pad assemblies comprises at least three smoothing pad assemblies attached to the rotatable plate at least approximately equidistant from each other.

15. The orbital smoothing device according to claim 14, wherein the plurality of smoothing pad assemblies comprises at least four smoothing pad assemblies.

16. An orbital smoothing device for smoothing a surface of a substrate, said orbital smoothing device comprising:

a) a rotatable plate, wherein said plate is driveable by a motor in at least one of a clockwise or a counterclockwise direction; and b) a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises:

i) a shaft for coupling the respective smoothing pad assembly to the rotatable plate;

ii) a bearing for providing independent rotation in both clockwise and counterclockwise directions mounted on the shaft and securable in a pad holder; and iii) a pad holder for receiving and securing the bearing therein, said pad holder having removably mounted thereon a smoothing pad capable of smoothing the surface of the substrate when the rotatable plate is driven by the motor, wherein each of the plurality of smoothing pad assemblies rotates independent of the other of the plurality of smoothing pad assemblies in the clockwise and/or the counterclockwise direction and the resistance of each of the plurality of smoothing pad assemblies against the surface of the substrate is substantially the only force that causes rotational movement of each of plurality of smoothing pad assemblies.

17. An orbital smoothing device for smoothing a surface of a substrate, said orbital smoothing device comprising:

a) a rotatable plate, wherein said plate is driveable by a motor in at least one of a clockwise or a counterclockwise direction; and b) a plurality of smoothing pad assemblies coupled to said plate, wherein each of said plurality of smoothing pad assemblies is capable of independent rotation in both clockwise and counterclockwise directions, and wherein each of said plurality of smoothing pad assemblies comprises:

i) a shaft for coupling the respective smoothing pad assembly to the rotatable plate;

ii) a spherical bushing for providing independent rotation in both clockwise and counterclockwise directions mounted on the shaft and securable in a pad holder; and iii) a pad holder for receiving and securing the spherical bushing therein, said pad holder having removably mounted thereon a smoothing pad capable of smoothing the surface of the substrate when the rotatable plate is driven by the motor, wherein each of the plurality of smoothing pad assemblies rotates independent of the other of the plurality of smoothing pad assemblies in the clockwise and/or the counterclockwise direction and the resistance of each of the plurality of smoothing pad assemblies against the surface of the substrate is substantially the only force that causes rotational movement of each of the plurality of smoothing pad assemblies, wherein the spherical bushing allows each of the plurality of smoothing pad assemblies to self level against the surface of the substrate being smoothed.

18. A method of smoothing a surface of a substrate using an orbital smoothing device, said orbital smoothing device comprising a rotatable plate driveable by a motor in at least one of a clockwise or a counterclockwise direction and a plurality of smoothing pad assemblies coupled to said plate, wherein each of said plurality of smoothing pad assemblies is capable of rotation independent of the other of the plurality of smoothing pad assemblies in both clockwise and counterclockwise directions, and wherein each of said plurality of smoothing pad assemblies comprises a shaft for coupling the respective smoothing pad assembly to the rotatable plate, means for providing independent rotation in both clockwise and counterclockwise directions mounted on the shaft and securable in a pad holder and a pad holder for receiving and securing the means for independent rotation, said pad holder having removably mounted thereon a smoothing pad capable of smoothing the surface of the substrate when the rotatable plate is driven by the motor, said method comprising the steps of:

a) contacting the surface of the substrate to be smoothed with the plurality of smoothing pad assemblies; and b) driving the rotatable plate by the motor in at least the clockwise or counterclockwise direction, wherein each of the plurality of smoothing pad assemblies rotates independent of the other of the plurality of smoothing pad assemblies in the clockwise and/or the counterclockwise direction due to friction between the smoothing pad of each of the plurality of smoothing pad assemblies and the surface to be smoothed and the resistance of each of the plurality of smoothing pad assemblies against the surface to be smoothed is substantially the only force that causes rotational movement of each of the plurality of smoothing pad assemblies.

19. The method according to claim 18, wherein the plurality of smoothing pad assemblies are not driven by an outside mechanical force.

* * * * *